US005698073A

United States Patent [19]

Vincenzi

[11] Patent Number: 5,698,073

[45] Date of Patent: Dec. 16, 1997

[54] AUTOMATIC SECTIONAL DOOR OPENER

[75] Inventor: Ariel Vincenzi, Simi Valley, Calif.

[73] Assignee: Hydromach Inc., Canoga Park, Calif.

[21] Appl. No.: 667,859

[22] Filed: Jun. 20, 1996

[51] Int. Cl.[6] ..... E05F 11/00

[52] U.S. Cl. ..... 160/188; 192/99 S; 292/DIG. 36

[58] Field of Search ..... 160/188, 189, 160/201; 192/69.63, 69.9, 89.27, 99 S; 292/DIG. 36, 219; 74/625

[56] References Cited

U.S. PATENT DOCUMENTS

| | | | |
|---|---|---|---|
| 2,260,080 | 10/1941 | Lane . | |
| 2,330,006 | 9/1943 | Odenthal . | |
| 2,344,276 | 3/1944 | Thompson . | |
| 2,534,525 | 12/1950 | Molloy . | |
| 2,651,817 | 9/1953 | Moler | 292/219 X |
| 2,670,065 | 2/1954 | Stevens | 74/625 X |
| 2,957,521 | 10/1960 | Greegor | 74/625 X |
| 3,134,273 | 5/1964 | Wardlaw | 74/625 |
| 3,319,303 | 5/1967 | Salvo . | |
| 3,349,516 | 10/1967 | Armstrong . | |
| 3,526,994 | 9/1970 | Delaney . | |
| 3,704,548 | 12/1972 | Wiegleb . | |
| 4,032,009 | 6/1977 | Taylor . | |
| 4,143,803 | 3/1979 | Taylor . | |
| 4,167,833 | 9/1979 | Farina et al. . | |
| 4,191,237 | 3/1980 | Voege . | |
| 4,247,806 | 1/1981 | Mercier . | |
| 4,254,582 | 3/1981 | McGee . | |
| 4,352,585 | 10/1982 | Spalding . | |
| 4,366,482 | 12/1982 | Remes et al. . | |
| 4,426,637 | 1/1984 | Apple et al. . | |
| 4,442,631 | 4/1984 | Weber . | |
| 4,472,910 | 9/1984 | Iha . | |
| 4,597,224 | 7/1986 | Tucker . | |
| 4,597,428 | 7/1986 | Iha . | |
| 4,653,565 | 3/1987 | Iha et al. . | |
| 4,684,853 | 8/1987 | Coash . | |
| 4,731,605 | 3/1988 | Nixon . | |
| 4,739,584 | 4/1988 | Zellman . | |
| 4,771,218 | 9/1988 | McGee . | |
| 4,791,757 | 12/1988 | Orlando . | |
| 4,792,659 | 12/1988 | Thomas . | |
| 4,794,732 | 1/1989 | Elardi . | |
| 4,819,379 | 4/1989 | Kenzelmann et al. . | |
| 4,867,498 | 9/1989 | Delphia et al. . | |
| 4,900,294 | 2/1990 | Schneeberger . | |
| 4,922,168 | 5/1990 | Waggamon et al. . | |
| 4,996,795 | 3/1991 | Niswonger . | |
| 5,020,845 | 6/1991 | Falcoff et al. . | |
| 5,027,553 | 7/1991 | Vergara . | |
| 5,111,906 | 5/1992 | Abadia . | |
| 5,137,500 | 8/1992 | Lhotak . | |
| 5,184,132 | 2/1993 | Baird . | |
| 5,209,089 | 5/1993 | Nelson . | |
| 5,222,327 | 6/1993 | Fellows et al. | 160/189 X |
| 5,226,257 | 7/1993 | Moss . | |
| 5,239,776 | 8/1993 | Lhotak . | |
| 5,247,232 | 9/1993 | Lin . | |
| 5,299,678 | 4/1994 | Chang et al. . | |
| 5,304,979 | 4/1994 | Lima et al. . | |
| 5,357,183 | 10/1994 | Lin . | |
| 5,444,440 | 8/1995 | Heydendahl . | |
| 5,465,033 | 11/1995 | Fassih-Nia . | |
| 5,475,366 | 12/1995 | Van Lente et al. . | |
| 5,533,561 | 7/1996 | Forehand | 292/DIG. 36 X |
| 5,557,887 | 9/1996 | Fellows et al. | 160/188 X |

*Primary Examiner*—David M. Purol

*Attorney, Agent, or Firm*—Kelly Bauersfeld; Lowry & Kelley, LLP

[57] ABSTRACT

An automatic opener for a sectional door includes a drive unit mounted adjacent to a door drive shaft and having a reversible motor, a gear linkage for translating rotation of the motor drive shaft into rotation of the sectional door drive shaft, and a clutch which permits the gear linkage to be manually temporarily disengaged from the motor drive shaft. The drive unit is supported within a housing that is connected to an adjustable wall bracket mounting base which itself is fixed to a wall adjacent to the sectional door. A spring-biased lever attached near a lower end of the sectional door pivots in response to slack in a door cable to automatically lock the door when it is completely shut. The locking mechanism automatically unlocks the door either when the drive unit is actuated to open the sectional door or when the clutch is utilized to disengage the gear linkage from the motor drive shaft.

30 Claims, 5 Drawing Sheets

FIG. 1
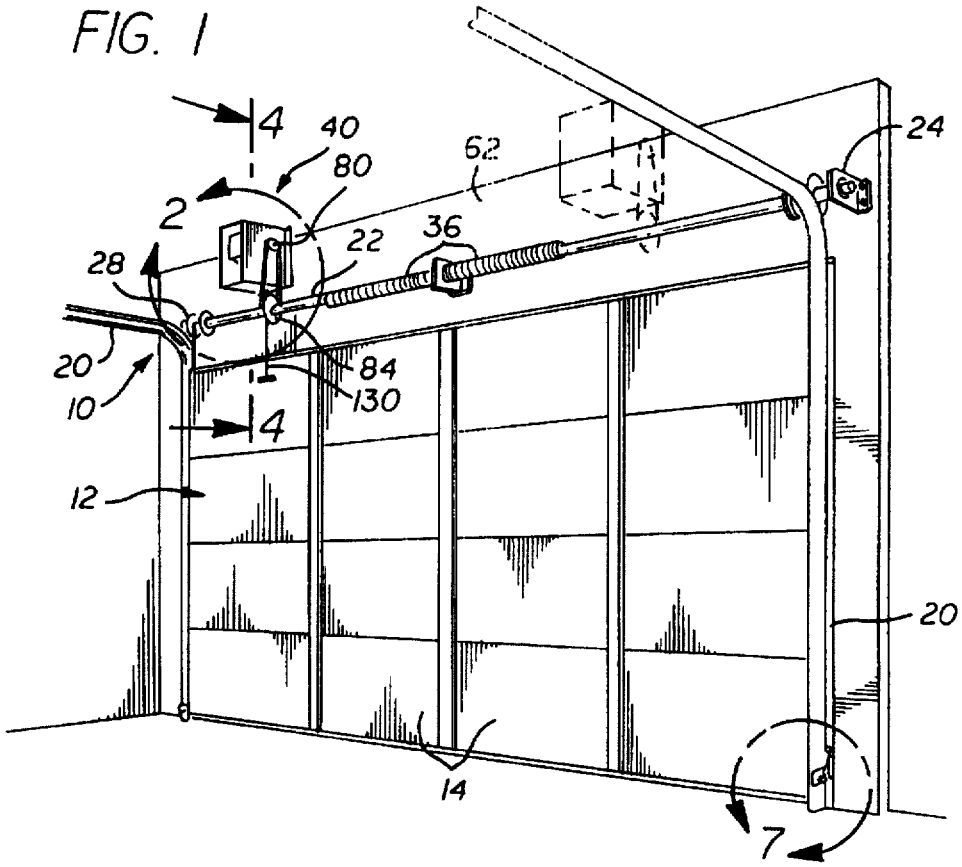
FIG. 8
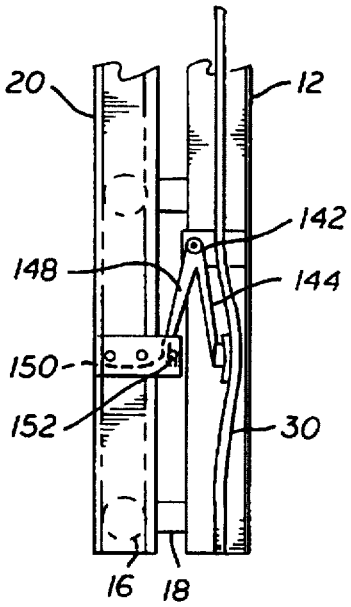
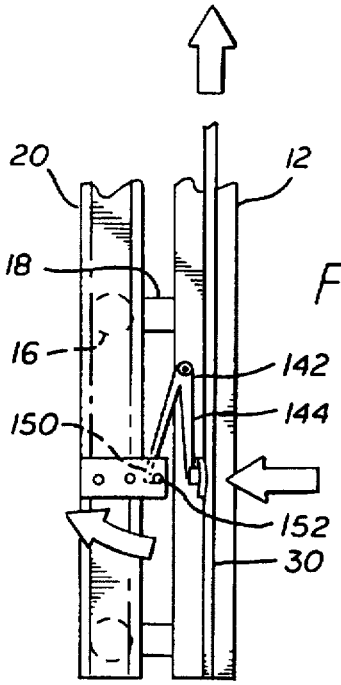
FIG. 9

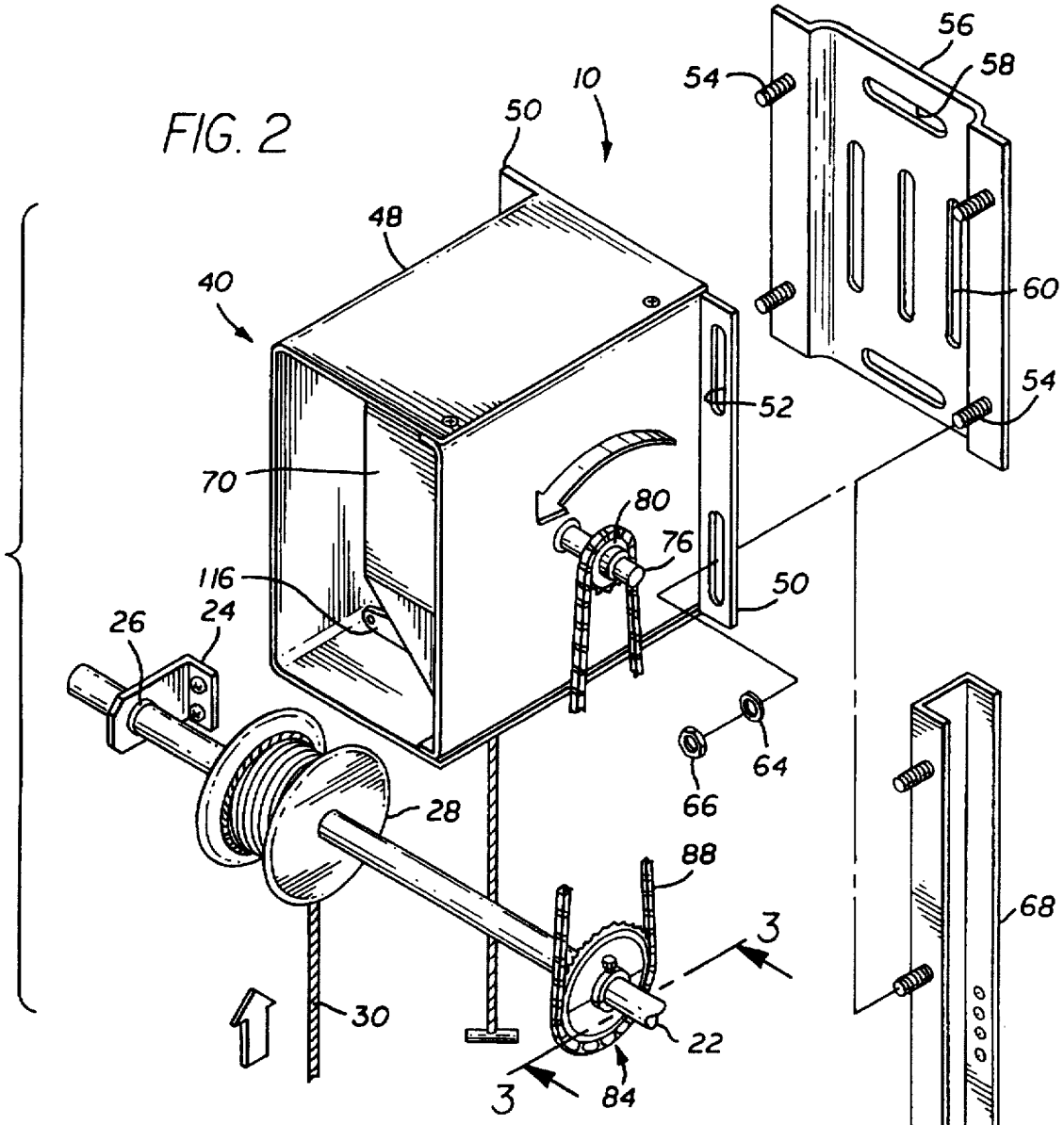
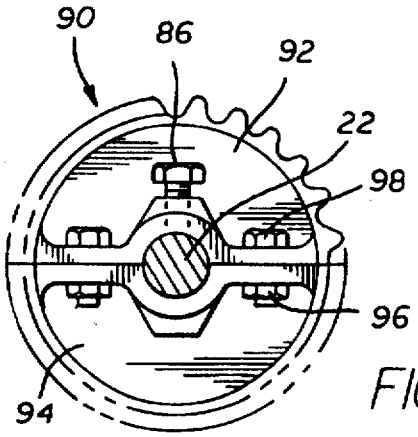
FIG. 3

134
100
108
40
74
42
110
82
70
78
136
72
124
112
80
78
76
102
114
44
122
88
120
126
38
128
118
116
130
46
48
132
138
24
86
22
28
84
30
140
12
20

AUTOMATIC SECTIONAL DOOR OPENER

BACKGROUND OF THE INVENTION

This invention relates to an operating mechanism for counterbalanced sectional doors adapted to open and close in response to a radio or other control signal. More specifically, the present invention relates to an automatic sectional door that requires only a single drive unit, and a mechanism that automatically locks the door when shut.

There are two broad categories of garage doors in common use, namely one-piece canopy doors and track guided multisection doors. The latter category of doors has interconnected sections which are supported at both ends in tracks which extend along the sides of the door opening and continue along the ceiling of the garage so that the connected sections may be slid upwardly and inwardly from a closed to an open position. A one-piece canopy door is typically used for smaller garage openings.

Recent advancements in the development of limited range transmitters has allowed their incorporation into devices known as automatic garage door openers. These devices utilize a motor which imparts motion to a traveling member of one sort or the other which is attached to the garage door. Upon remote activation by a transmitter or switch, the motor is energized and the garage door is opened or closed.

The automatic garage door opener allows for opening and closing of the garage door without having to exit from a motor vehicle or the like which one is desirous placing in or taking out of the garage. This is both a safety factor, protecting the occupants of the vehicle from exposing themselves to potential danger outside of their vehicle and the garage, and a convenience feature in inclement weather and the like.

Although the automatic garage door opener has many positive features which are contributing significantly to its popularity, such devices do not offer the security in locking a garage door which other, conventional locks, pad locks and the like, offer. Unless the user of the automatic garage door opener incorporates a separate locking system, the only factor holding the garage door in a closed position is the linkage connecting the automatic garage door opener to the garage door. Depending upon the brand of automatic garage door opener, this linkage may or may not be strong enough to resist someone forcing the garage door open. Thus, it is evident that if the garage door is only held in the closed position by the automatic garage door opener, it is easily possible to penetrate the security of the garage by overcoming either the linkage mechanism of the opener or the attachment of the opener to the garage. Moreover, it is sometimes desirable to be able to open and close the garage door without activating the garage door opener. This is quite difficult with most garage door openers because of the linkage provided between a garage door opener drive unit and the garage door.

Accordingly, there has been a need for a novel automatic opener for a sectional door, including track guided multisection garage doors, which overcome the drawbacks of the prior art. In particular, such an automatic opener is needed which provides means for automatically locking the sectional door when fully closed. On activation of the automatic opener, the locking mechanism must automatically disengage to permit the sectional door to be open automatically. Moreover, there must be provided a means for releasing the automatic lock from a remote location without requiring activation of the automatic opener. Further, there is a need for an automatic opener for a sectional door that may be mounted virtually anywhere along the length of a sectional door drive shaft, which requires the use of only one drive unit, and which provides means for disengaging the drive unit from the automatic opener linkage when desired. The present invention fulfills these needs and provides other related advantages.

SUMMARY OF THE INVENTION

The present invention resides in an automatic opener for a sectional door, which may be mounted virtually anywhere over the door opening along the length of a sectional door drive shaft, which utilizes a single drive unit to both raise and lower the sectional door, includes an automatic locking mechanism for locking the sectional door when fully closed, and which further includes a clutch mechanism for manually disengaging the drive unit from the door positioning linkage assembly. The automatic opener of the present invention comprises a sectional door drive shaft extending along a side of the sectional door, a door cable attached at a first end to the sectional door and at a second end to the sectional door drive shaft, and means for rotating the sectional door drive shaft. The rotating means includes a reversible motor and a gear linkage for translating rotation of a motor drive shaft into rotation of the sectional door drive shaft.

In a preferred form of the invention, the gear linkage includes a drive unit drive shaft which extends generally perpendicularly relative to the motor drive shaft, and a gear mounted to the drive unit drive shaft. The gear is slidable along the length of the drive unit drive shaft between a first position wherein the gear is driven by a worn fixed to the motor drive shaft, and a second position wherein the gear is disengaged from the worm. The rotating means further includes a first sprocket fixed to the drive unit drive shaft, a second sprocket fixed to the sectional door drive shaft, and an endless chain which extends about the first and second sprockets.

A clutch is provided which permits the gear linkage to be manually temporarily disengaged from the motor drive shaft. The clutch includes means for biasing the gear into its first position, and manually actuable means for moving the gear against the biasing means into its second position. The biasing means comprises a compression spring. The means for moving the gear to its second position includes a gear abutment having a peripheral groove and which is fixed to a face of the gear and is slidable therewith along the drive unit drive shaft, and a pivot lever. The pivot lever is pivotally connected adjacent to the rotating means, and includes a first arm that supports a groove follower disposed within the groove, and a second arm that may be pulled to pivot the pivot lever about its pivotal connection to cause movement of the groove follower away from the worm and thus move the gear toward the second position.

Means are provided for rotationally coupling the gear to the drive unit drive shaft when the gear is in its first position. In one embodiment, the coupling means includes a key which is fixed to and extends longitudinally along the drive unit drive shaft. In another embodiment, the coupling means includes a locking pin which extends from the drive unit drive shaft, and a slot associated with the gear into which the locking pin is placed when the gear is in its first position.

Means are also provided for automatically locking the sectional door when fully closed. The locking means automatically disengages when the automatic opener is actuated to open the sectional door. The automatic locking means comprises a spring-biased lever which is pivotally attached to the sectional door adjacent to the first end of the door cable. The lever includes a cable abutment arm having an end thereof that abuts a portion of the door cable adjacent to the first end thereof, and a locking arm including a hook for engaging a locking pin fixed to a stationary structure. Slack in the door cable, when the sectional door is fully closed, permits the lever to pivot such that the hook engages the locking pin. Removal of the door cable slack, as when the sectional door is being opened, causes the lever to pivot in an opposite direction to release the hook from the locking pin.

Means are also provided for manually unlocking the automatic locking means from a remote location. The unlocking means includes a lock mechanism fixed relative to a selected structure, the lock mechanism including a housing that may be rotated by means of a key. The lock housing has attached thereto a rope which extends to the second arm of the clutch pivot lever. Spooling of the rope onto the lock mechanism causes the clutch to disengage the gear from the worm, thus disengaging the automatic locking means.

Means are provided for mounting the rotating means to a wall adjacent to the sectional door drive shaft. The mounting means includes a wall bracket mounting base which is adjustably positionable relative to selected attachment points on the wall, and a drive unit housing which is attachable to the mounting base and adjustably positionable with respect thereto. The wall bracket mounting base includes a plurality of horizontal slots and a plurality of vertical slots through which connectors may be placed for securing the mounting base to the wall.

In use, the reversible motor is actuated to turn the drive unit drive shaft in a first direction in order to turn the sectional door drive shaft in a manner to unreel the door cable from a pair of pull reels. Adjustment is made to the automatic opener so that the reversible motor is actuated just long enough to cause the sectional door to fully close and to turn the sectional door drive shaft a little more in order to induce slack within the door cable. When the automatic locking means detects such door cable slack, the hook engages the locking pin to lock the sectional door in the closed position. In order to release the automatic locking means, the slack in the door cable must be removed either by reversing the rotational direction of the motor drive shaft to wind the door cable onto the pull reels, or to utilize the clutch to disengage the gear mounted to the drive unit drive shaft from the worm fixed to the motor drive shaft. When this occurs, the counterbalance springs about the sectional door drive shaft rotate the pull reels in a direction to eliminate door cable slack, thus also disengaging the automatic locking means to unlock the sectional door. With the clutch so configured, the sectional door may be easily manually raised and lowered as desired.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of a sectional garage door movable along a pair of guide rails in response to an automatic door opener embodying the invention;

FIG. 2 is a fragmented, enlarged exploded perspective view taken generally of the area indicated by the number 2 in FIG. 1, of a sectional door opener drive unit and associated components of the automatic opener of the present invention;

FIG. 3 is an enlarged elevational view of a second sprocket mounted to a sectional door drive shaft, taken generally along the line 3—3 of FIG. 2;

FIG. 8 is an elevational view of the automatic locking mechanism taken generally along the line 8—8 of FIG. 7, illustrating the manner in which a hook engages a locking pin when slack exists in the door cable; and FIG. 9 is an elevational view similar to FIG. 8, illustrating the manner in which the hook is caused to disengage the locking pin when slack is removed from the door cable.

DETAILED DESCRIPTION OF THE PREFERRED EMBODIMENTS

Figure 4:
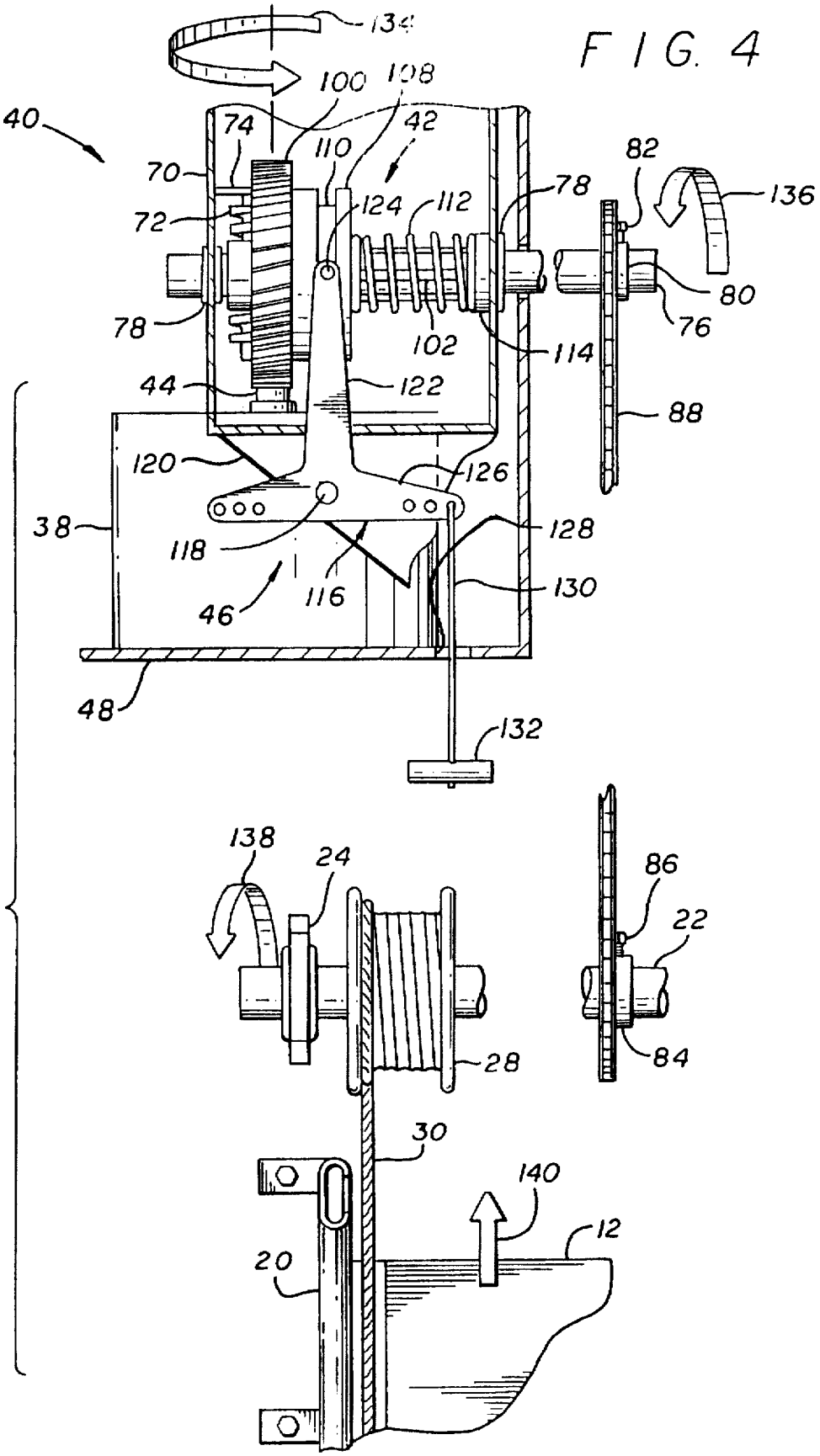
FIG. 4 is an enlarged, fragmented partially sectional view of the automatic opener taken generally along the line 4—4 of FIG. 1, wherein a gear linkage is positioned into engagement with a worm on a motor drive shaft.
Figure 5:
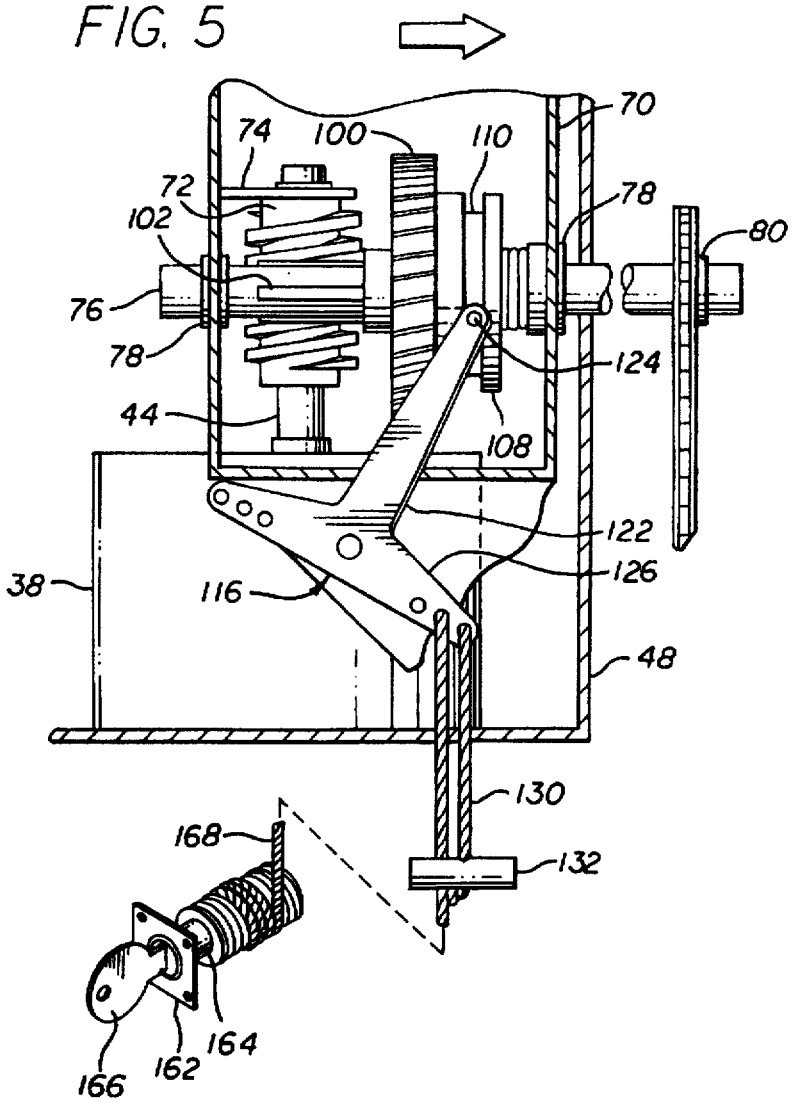
FIG. 5 is an enlarged, fragmented sectional view similar to that illustrated in FIG. 4, illustrating the manner in which a clutch may be manually actuated, either through a manual pull-down rope or through a keyed lock mechanism, to disengage the gear linkage from the motor drive shaft.

As shown in the drawings for purposes of illustration, the present invention is concerned with an improved automatic sectional door opening system, generally designed in FIG. 1 by the reference number 10. The automatic door opening system 10 is designed to be utilized in connection with a sectional door 12 having a plurality of articulating door panels 14 which move from a generally vertical orientation when the door 12 is closed to a generally horizontal orientation when the door is opened. The door panels 14 include rollers 16 mounted on arms 18 which extend laterally outwardly from the door panels 14, wherein the rollers 16 are guided along a pair of track-like guide rails 20.

Figure 7:
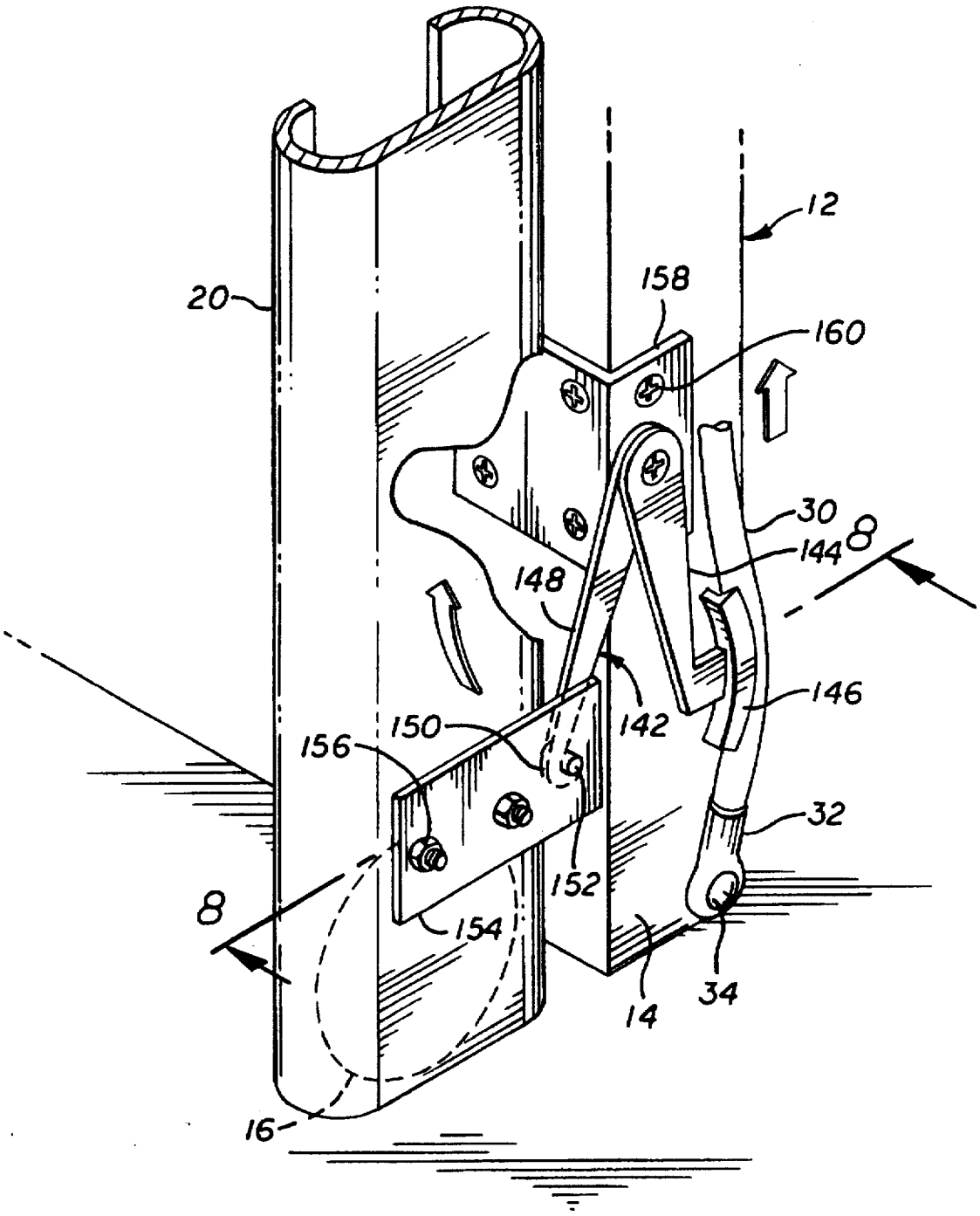
FIG. 7 is an enlarged fragmented perspective view of the area indicated by the number 7 in FIG. 1, illustrating a locking mechanism that automatically locks the sectional door in a closed position when a door cable is fully extended.

A sectional door drive shaft 22 extends generally adjacent to one edge of the wall opening which the sectional door 12 is intended to close. In connection with the garage door 12 illustrated in the accompanying drawings, the sectional door drive shaft 22 is mounted over the garage door opening by means of mounting brackets 24 which may include a bearing 26 to facilitate rotation of the sectional door drive shaft 22 through the mounting brackets 24. A pair of pull reels 28 are mounted to the sectional door drive shaft 22 and align with respective edges of the sectional door 12. A pair of door cables 30 are provided with eye connectors 32 at the first ends thereof, through which a bolt 34 is inserted to secure the eye connectors 32 to the lower end of respective sides of the sectional door 12 (see FIG. 7). The opposite or second ends of the door cables 30 are attached to respective pull reels 28 such that the door cables may be wound about the pull reels as the sectional door drive shaft 22 is rotated.

A pair of counterbalance springs 36 are associated with the sectional door drive shaft 22 in a known manner to bias the sectional door 12 upwardly. As will be described in greater detail below, the counterbalance springs 36 will tend to rotate the sectional door drive shaft 22 in a manner to remove slack from the door cables 30 when the sectional door drive shaft is operatively disconnected from a reversible motor 38 of the automatic sectional door opening system 10 to thereby unlock the sectional door 12 and permit it to slide upwardly along the guide rails 20.

In accordance with the present invention and with reference to FIGS. 2–5, the automatic sectional door opening system 10 includes a drive unit 40 for rotating the sectional door drive shaft 22, wherein the drive unit includes the reversible motor 38 and a gear linkage 42 for translating rotation of a drive shaft 44 for the reversible motor 38 into rotation of the sectional door drive shaft 22. The system 10 further includes a clutch 46 which permits the gear linkage 42 to be manually temporarily disengaged from the motor drive shaft 44, and means for automatically locking the sectional door 12 when fully closed (see FIGS. 7–9).

The drive unit 40 includes a rigid housing 48 which provides support for the reversible motor 38 therein. The drive unit housing 48 includes a pair of outwardly extending attachment flanges 50 which each include a pair of vertical slots 52. The vertical slots 52 are positioned so as to receive therethrough four threaded studs 54 which extend from a wall bracket mounting base 56. Use of the vertical slots 52 may be advantageously utilized to adjust the chain 88 tension. The mounting base 56 includes a plurality of horizontally extends slots 58 and a plurality of vertically extending slots 60. It is through these slots 58 and 60 that the mounting base is affixed to a portion of the wall adjacent to the sectional door drive shaft 22. As illustrated in FIG. 1, the mounting base 56, and thus the drive unit 40, may be mounted virtually anywhere along the length of the sectional door drive shaft 22. Further, the automatic sectional door opening system 10 of the present invention permits the drive unit 40 to be mounted below the sectional door drive shaft 22, if desired.

Suitable connectors, such as bolts, are bored into the wall 62 surrounding the sectional door 12 and immediately adjacent to the sectional door drive shaft 22 for purposes of securing the wall bracket mounting base 56 thereto. The slots 58 and 60 permit the precise location of the drive unit 40 to be optimized, irrespective of the required placement of the mounting bolts through the slots 58 and 60. The threaded studs 54 extending from the mounting base 56 are then placed through the vertical slots 52 of the attachment flanges 50 of the drive unit housing 48, which are then secured in place by means of washers 64 and nuts 66. Also illustrated in FIG. 2 is a U-shaped extension mounting bracket 68. This extension mounting bracket 68 may be itself mounted to the threaded studs 54 of the mounting base 56 if needed to precisely position the drive unit 40 in the optimum location relative to the sectional door drive shaft 22. The extension mounting bracket 68 is only used, however, when necessary.

A gear subhousing 70 is provided within the drive unit housing 48 for purposes of supporting various components of the gear linkage 42 and clutch 46. The motor drive shaft 44 extends upwardly into the interior of the gear subhousing 70, and a worm 72 is fixed to the motor drive shaft 44. The free end of the motor drive shaft 44 is supported by means of a support flange 74 which extends inwardly from an interior surface of the gear subhousing 70.

The gear linkage 42 includes a drive unit drive shaft 76 which extends generally perpendicularly relatively to the motor drive shaft 44. The drive unit drive shaft turns through bearings 78 supported by the walls of the gear subhousing 70 and has an output end which extends outwardly from the drive unit housing 48. Attached this output end is a first sprocket 80 fixed in place by means of a lock bolt 82. The first sprocket 80 is aligned with a second sprocket 84 fixed to the sectional door drive shaft 22 also by means of a lock bolt 86, and the two sprockets 80 and 84 are linked together by an endless chain 88. By means of the aligned sprockets 80 and 84 and the endless chain 88, rotation of the drive unit drive shaft 76 is translated directly into rotation of the sectional door drive shaft 22.

With reference to FIG. 3, a split drive sprocket 90 may be provided for the second sprocket 84 when installation of the second sprocket 84 is desired between the pull reels 28. The split drive sprocket 90 includes a first half 92 and a second half 94 which may be clamped together by means of nuts and bolts 96 and 98 as shown.

Figure 6:
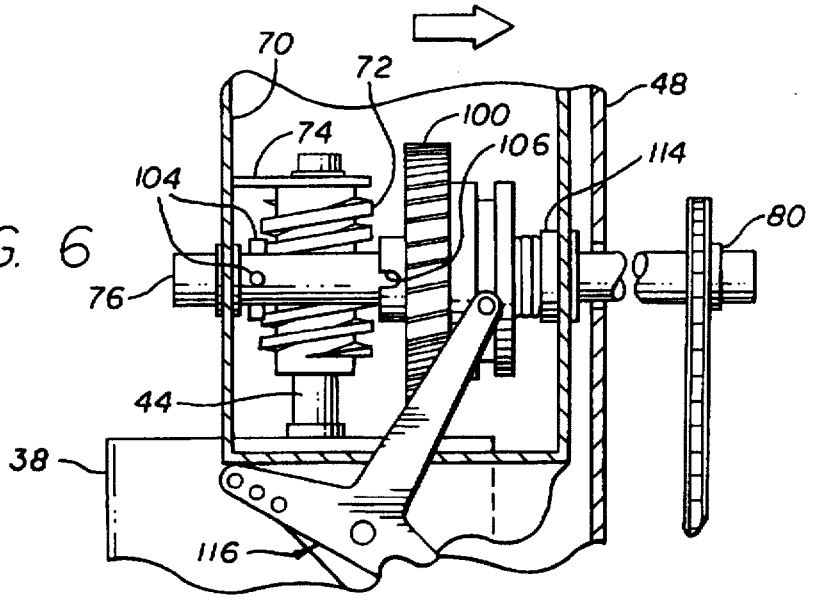
FIG. 6 is an enlarged, fragmented sectional view similar to that shown in FIG. 5, showing an alternative embodiment wherein a locking pin extending from the drive unit drive shaft is utilized to engage a slot on a gear to prevent relative rotation therebetween when the gear is positioned to be engaged by the worm of the motor drive shaft.

A gear 100 is mounted to the drive unit drive shaft 76 within the gear subhousing 70. The gear 100 is slidable along the length of the drive unit drive shaft 76 between a first position wherein the gear engages and is driven by the worm 72, and a second position wherein the gear is disengaged from the worm. In this regard, means are provided for rotationally coupling the gear 100 to the drive unit drive shaft 76. The coupling means includes a key 102 which is fixed to and extends longitudinally along the drive unit drive shaft. The gear 100 includes a slot which slides over the key 102 to ensure that any rotation of the gear 100 is translated directly into rotation of the drive unit drive shaft 76. In an alternative embodiment illustrated in FIG. 6, the key 102 is replaced with a locking pin or pins 104 which extend from the drive unit drive shaft 76, and a slot or slots 106 associated with the gear 100 into which the locking pin or pins 104 is/are placed when the gear 100 is in its first position.

The clutch 46 includes a gear abutment 108 which has a peripheral groove 110 and which is fixed to a face of the gear 100 to be slidable therewith along the drive unit drive shaft 76. A compression spring 112 abuts a face of the gear abutment 108 opposite the gear 100 and extends about the drive unit drive shaft 76 to a bushing 114. The compression spring 112 serves to bias the gear 100 into its first position. An inverted T-shaped pivot lever 116 is attached by means of a pivot shaft 118 to a stationary structure or wall 120 associated with the drive unit housing 48. The pivot lever 116 has a first arm 122 that supports a groove follower 124 disposed within the groove 110, and a second arm 126 that may be pulled to pivot the pivot lever 116 about the pivot shaft 118 to cause movement of the groove follower 124 away from the worm 72 and thus move the gear abutment 108 and the attached gear 100 out of the first position toward the second position. An aperture 128 is provided through the bottom of the drive unit housing 48, and a pull-down rope 130 attached to an end of the second arm 126 extends through the aperture 128 to a handle 132. This arrangement permits one to simply grab the handle 132 and pull downwardly in order to utilize the clutch 46 to disengage the gear 100 from the worm 72, when desired. a conventional limit switch (not shown) is installed on the gear shaft 76. This allows a user to manually disconnect the drive unit 40, and when the drive unit is reconnected, the system 10 resumes normal operation without losing any adjustment.

In operation, the drive unit 40 may be actuated by a radio signal or in any other standard manner in order to cause the worm 72 to turn in the direction indicated by the arrow 134 of FIG. 4 in order to raise the sectional door 12. Such rotation of the worm 72 causes the gear 100, and thus the drive unit drive shaft 76 and the first sprocket 80 to turn in the direction indicated by the arrow 136 of FIG. 4. Such movement results in rotation of the sectional door drive shaft 22 in the direction indicated by the arrow 138 which causes the door cables 30 to be wound about the pull reels 28 as the door 12 moves upwardly as shown by the arrow 140.

When the reversible motor 38 is actuated to turn in an opposite direction, the door 12 is lowered by the door cables 30 until it is completely shut. For purposes of locking the sectional door 12 when shut, it is important for purposes of the present invention that the reversible motor 38 remain actuated for a brief time after the sectional door 12 is fully closed in order to induce slack into the door cables 30 (see FIGS. 7 and 8). In this regard, means are provided for automatically locking the sectional door 12 when fully closed, wherein the locking means automatically disengages when the automatic opener 10 is actuated to open the sectional door 12.

The automatic locking means comprises a spring-biased lever 142 which is pivotally attached to the sectional door 12 adjacent to the eye connectors 32 of the door cables 30. The lever 142 includes a cable abutment arm 144 which carries a cable abutment member 146 that abuts a portion of the door cable 30 adjacent to the eye connector 32, and a locking arm 148 which includes a hook 150 for engaging a locking pin 152 fixed to a lower end of the associated guide rail 20. The locking pin 52 extends outwardly from a mounting plate 154 which is secured to the guide rail 20 by means of suitable fasteners 156. An L-shaped mounting bracket 158 is attached to a lower end of the sectional door 12 by means of screws 160 to provide an attachment point for the lever 142 to the respective door panel 14. The cable abutment arm 144 and the locking arm 148 are provided a segmented locking interface on adjoining surfaces which permit the relative angle between the two arms to be varied prior to pivotally securing them to the L-shaped mounting bracket 158.

When the sectional door 12 is lowered into the closed position and slack is induced into the door cables 30 by delayed shutoff of the reversible motor 38, the spring biased lever 142 pivots toward the door cable 30 and the slack in the door cable permits the hook 150 to engage the locking pin 152. This prevents the sectional door 12 from being manually slid upwardly and provides an automatic safety locking feature of the system 10. Immediately upon removal of the slack from the door cables 30, the door cable 30 presses against the cable abutment member 146 to pivot the lever 142 in an opposite direction thereby disengaging the hook 150 from the locking member 152. Thus, either on actuation of the reversible motor 38 to pull the sectional door upwardly, or on disengagement of the gear 100 from the worm 72, slack in the door cables 30 is immediately eliminated, thus causing the hook 150 to disengage from the locking pin 152. It is the counterbalance springs 36 that remove slack from the door cables 30 when the gear 100 is disengaged from the worm 72 (see FIG. 9).

At times it is necessary to unlock the sectional door 12 without actuating the reversible motor 38 and at a location remote from the clutch 46, such as at a location outside of the garage. In this case, means are provided for manually unlocking the automatic locking means in the form of a lock mechanism 162 which is fixed relative to a selected structure (see FIG. 5). The lock mechanism includes a housing 164 that may be rotated by means of a key 166. The lock housing 164 has attached thereto a rope 168 which extends to the second arm 126 of the pivot lever 116. The key 166 may be turned to spool the rope 168 onto the lock mechanism 162 for purposes of disengaging the gear 100 from the worm 72. As stated above, such disengagement allows the counterbalance springs 36 to remove slack from the door cables 30, thus disengaging the hooks 150 from the locking pins 152.

From the foregoing it is to be appreciated that a relatively simple automatic sectional door opening system 10 is provided which has great versatility and can be utilized in connection with virtually any type of rail-guided sectional door. The clutch 46 permits the gear linkage 42 to be easily uncoupled from the motor 38, and the automatic door lock provides a safety feature to the sectional door 12 when fully closed. Further, in order to prevent the door 12 from being forced open, the automatic locking means is preferably provided on each side of the door.

Although a particular embodiment of the invention has been described in detail for purposes of illustration, various modifications may be made without departing from the spirit and scope of the invention. Accordingly, the invention is not to be limited, except as by the appended claims.

I claim:

1. A sectional door having an automatic opener for raising and lowering the door, the automatic opener comprising:

a sectional door drive shaft extending along a side of the sectional door;

a door cable attached at a first end to the sectional door, and at a second end to the sectional door drive shaft;

means for rotating the sectional door drive shaft, the rotating means including a reversible motor and a gear linkage for translating rotation of a motor drive shaft into rotation of the sectional door drive shaft; and a clutch permitting the gear linkage to be manually temporarily disengaged from the motor drive shaft;

wherein the gear linkage includes a drive unit drive shaft extending generally perpendicularly relative to the motor drive shaft, and a gear mounted to the drive unit drive shaft and slidable therealong between a first position wherein the gear is driven by a worm fixed to the motor drive shaft, and a second position wherein the gear is disengaged from the worm.

2. The automatic opener of claim 1, wherein the clutch includes means for biasing the gear into its first position, and manually actuable means for moving the gear against the biasing means into its second position.

3. The automatic opener of claim 2, wherein the biasing means comprises a compression spring, and wherein the means for moving the gear to its second position includes a gear abutment having a peripheral groove and which is fixed to a face of the gear and slidable therewith along the drive unit drive shaft, and a pivot lever pivotally connected adjacent to the rotating means, the pivot lever having a first arm that supports a groove follower disposed within the groove, and a second arm that may be pulled to pivot the pivot lever about its pivotal connection to cause movement of the groove follower away from the worm and thus move the gear abutment and the attached gear out of the first position toward the second position.

4. The automatic opener of claim 3, including means for rotationally coupling the gear to the drive unit drive shaft when the gear is in its first position.

5. The automatic opener of claim 4, wherein the coupling means includes a locking pin extending from the drive unit drive shaft, and a slot associated with the gear into which the locking pin is placed when the gear is in its first position.

6. The automatic opener of claim 4, wherein the coupling means includes a key fixed to and extending longitudinally along the drive unit drive shaft, for preventing relative rotation between the gear and the drive shaft.

7. The automatic opener of claim 1, including means for mounting the rotating means to a wall adjacent to the sectional door drive shaft, the mounting means including a wall bracket mounting base adjustably positionable relative to attachment points to the wall, and a drive unit housing attachable to the mounting base and adjustably positionable with respect thereto.

8. The automatic opener of claim 7, wherein the wall bracket mounting base includes a plurality of horizontal slots and a plurality of vertical slots through which connectors may be placed for securing the mounting base to the wall.

9. The automatic opener of claim 1, wherein the rotating means includes a first sprocket fixed to the drive unit drive shaft, a second sprocket fixed to the sectional door drive shaft, and an endless chain extending about the first and second sprockets.

10. The automatic opener of claim 1, including means for automatically locking the sectional door when fully closed, wherein the locking means automatically disengages when the automatic opener is actuated to open the sectional door.

11. The automatic opener of claim 10, wherein the automatic locking means comprises a spring-biased lever pivotally attached to the sectional door adjacent to the first end of the door cable, the lever including a cable abutment arm having an end thereof that abuts a portion of the door cable adjacent to the first end thereof, and a locking arm including a hook for engaging a locking pin fixed to a stationary structure, wherein slack in the door cable permits the lever to pivot such that the hook engages the locking pin, and wherein removal of the door cable slack causes the lever to pivot in an opposite direction to release the hook from the locking pin.

12. The automatic opener of claim 10, including means for manually unlocking the automatic locking means from a remote location.

13. A sectional door having an automatic opener for raising and lowering the door, the automatic opener comprising:

a sectional door drive shaft extending along a side of the sectional door;

a door cable attached at a first end to the sectional door, and at a second end to the sectional door drive shaft;

means for rotating the sectional door drive shaft, the rotating means including a reversible motor and a gear linkage for translating rotation of a motor drive shaft into rotation of the sectional door drive shaft; and means for automatically locking the sectional door when fully closed, wherein the locking means automatically disengages when the automatic opener is actuated to open the sectional door, wherein the automatic locking means comprises a spring-biased lever pivotally attached to the sectional door adjacent to the first end of the door cable, the lever including a cable abutment arm having an end thereof that abuts a portion of the door cable adjacent to the first end thereof, and a locking arm including a hook for engaging a locking pin fixed to a stationary structure, wherein slack in the door cable permits the adjustment lever to pivot such that the hook engages the locking pin, and wherein removal of the door cable slack causes the lever to pivot in an opposite direction to release the hook from the locking pin.

14. The automatic opener of claim 13, wherein the rotating means includes a first sprocket fixed to the drive unit drive shaft, a second sprocket fixed to the sectional door drive shaft, and an endless chain extending about the first and second sprockets.

15. The automatic opener of claim 13, including means for mounting the rotating means to a wall adjacent to the sectional door drive shaft, the mounting means including a wall bracket mounting base adjustably positionable relative to attachment points to the wall, and a drive unit housing attachable to the mounting base and adjustably positionable with respect thereto, wherein the wall bracket mounting base includes a plurality of horizontal slots and a plurality of vertical slots through which connectors may be placed for securing the mounting base to the wall.

16. A sectional door having an automatic opener for raising and lowering the door, the automatic opener comprising:

a sectional door drive shaft extending along a side of the sectional door;

a door cable attached at a first end to the sectional door, and at a second end to the sectional door drive shaft;

means for rotating the sectional door drive shaft, the rotating means including a reversible motor and a gear linkage for translating rotation of a motor drive shaft into rotation of the sectional door drive shaft;

means for automatically locking the sectional door when fully closed, wherein the locking means automatically disengages when the automatic opener is actuated to open the sectional door; and a clutch permitting the gear linkage to be manually temporarily disengaged from the motor drive shaft, wherein the gear linkage includes a drive unit drive shaft extending generally perpendicularly relative to the motor drive shaft, and a gear mounted to the drive unit drive shaft and slidable therealong between a first position wherein the gear is driven by a worm fixed to the motor drive shaft, and a second position wherein the gear is disengaged from the worm, wherein the clutch includes means for biasing the gear into its first position, and manually actuable means for moving the gear against the biasing means into its second position.

17. The automatic opener of claim 16, wherein the biasing means comprises a compression spring, and wherein the means for moving the gear to its second position includes a gear abutment having a peripheral groove and which is fixed to a face of the gear and slidable therewith along the drive unit drive shaft, and a pivot lever pivotally connected adjacent to the rotating means, the pivot lever having a first arm that supports a groove follower disposed within the groove, and a second arm that may be pulled to pivot the pivot lever about its pivotal connection to cause movement of the groove follower away from the worm and thus move the gear abutment and the attached gear out of the first position toward the second position.

18. The automatic opener of claim 17, including means for manually unlocking the automatic locking means from a remote location, wherein the unlocking means includes a lock mechanism fixed relative to a selected structure, the lock mechanism including a housing that may be rotated by means of a key, wherein the lock housing has attached thereto a rope which extends to the second arm of the clutch pivot lever, whereby spooling of the rope onto the lock mechanism causes the clutch to disengage the gear from the worm, thus disengaging the automatic locking means.

19. A sectional door having an automatic opener for raising and lowering the door, the automatic opener comprising:

a sectional door drive shaft extending along a side of the sectional door;

a door cable attached at a first end to the sectional door, and at a second end to the sectional door drive shaft;

means for rotating the sectional door drive shaft, the rotating means including a reversible motor and a gear linkage for translating rotation of a motor drive shaft into rotation of the sectional door drive shaft, the gear linkage including a first sprocket fixed to the drive unit drive shaft, a second sprocket fixed to the sectional door drive shaft, and an endless chain extending about the first and second sprockets;

a clutch permitting the gear linkage to be manually temporarily disengaged from the motor drive shaft; and means for automatically locking the sectional door when fully closed, wherein the locking means automatically disengages when the automatic opener is actuated to open the sectional door, wherein the automatic locking means comprises a spring-biased lever pivotally attached to the sectional door adjacent to the first end of the door cable, the lever including a cable abutment arm having an end thereof that abuts a portion of the door cable adjacent to the first end thereof, and a locking arm including a hook for engaging a locking pin fixed to a stationary structure, wherein slack in the door cable permits the adjustment lever to pivot such that the hook engages the locking pin, and wherein removal of the door cable slack causes the lever to pivot in an opposite direction to release the hook from the locking pin.

20. The automatic opener of claim 19, including means for mounting the rotating means to a wall adjacent to the sectional door drive shaft, the mounting means including a wall bracket mounting base adjustably positionable relative to attachment points to the wall, and a drive unit housing attachable to the mounting base and adjustably positionable with respect thereto, wherein the wall bracket mounting base includes a plurality of horizontal slots and a plurality of vertical slots through which connectors may be placed for securing the mounting base to the wall.

21. The automatic opener of claim 19, wherein the gear linkage includes a drive unit drive shaft extending generally perpendicularly relative to the motor drive shaft, and a gear mounted to the drive unit drive shaft and slidable therealong between a first position wherein the gear is driven by a worm fixed to the motor drive shaft, and a second position wherein the gear is disengaged from the worm, wherein the clutch includes means for biasing the gear into its first position, and manually actuable means for moving the gear against the biasing means into its second position.

22. The automatic opener of claim 21, wherein the biasing means comprises a compression spring, and wherein the means for moving the gear to its second position includes a gear abutment having a peripheral groove and which is fixed to a face of the gear and slidable therewith along the drive unit drive shaft, and a pivot lever pivotally connected adjacent to the rotating means, the pivot lever having a first arm that supports a groove follower disposed within the groove, and a second arm that may be pulled to pivot the pivot lever about its pivotal connection to cause movement of the groove follower away from the worm and thus move the gear abutment and the attached gear out of the first position toward the second position.

23. The automatic opener of claim 22, including means for manually unlocking the automatic locking means from a remote location, wherein the unlocking means includes a lock mechanism fixed relative to a selected structure, the lock mechanism including a housing that may be rotated by means of a key, wherein the lock housing has attached thereto a rope which extends to the second arm of the clutch pivot lever, whereby spooling of the rope onto the lock mechanism causes the clutch to disengage the gear from the worm, thus disengaging the automatic locking means.

24. The automatic opener of claim 21, including means for rotationally coupling the gear to the drive unit drive shaft when the gear is in its first position.

25. A sectional door having an automatic opener for raising and lowering the door, the automatic opener comprising:

a sectional door drive shaft extending along a side of the sectional door;

a door cable attached at a first end to the sectional door, and at a second end to the sectional door drive shaft;

means for rotating the sectional door drive shaft, the rotating means including a reversible motor and a gear linkage for translating rotation of a motor drive shaft into rotation of the sectional door drive shaft;

a clutch permitting the gear linkage to be manually temporarily disengaged from the motor drive shaft; and means for automatically locking the sectional door when fully closed, wherein the locking means automatically disengages when the automatic opener is actuated to open the sectional door, wherein the automatic locking means comprises a spring-biased lever pivotally attached to the sectional door adjacent to the first end of the door cable, the lever including a cable abutment arm having an end thereof that abuts a portion of the door cable adjacent to the first end thereof, and a locking arm including a hook for engaging a locking pin fixed to a stationary structure, wherein slack in the door cable permits the lever to pivot such that the hook engages the locking pin, and wherein removal of the door cable slack causes the lever to pivot in an opposite direction to release the hook from the locking pin.

26. The automatic opener of claim 25, including means for manually unlocking the automatic locking means from a remote location.

27. A sectional door having an automatic opener for raising and lowering the door, the automatic opener comprising:

a sectional door drive shaft extending along a side of the sectional door;

a door cable attached at a first end to the sectional door, and at a second end to the sectional door drive shaft;

means for rotating the sectional door drive shaft, the rotating means including a reversible motor and a gear linkage for translating rotation of a motor drive shaft into rotation of the sectional door drive shaft, the gear linkage including a first sprocket fixed to the drive unit drive shaft, a second sprocket fixed to the sectional door drive shaft, and an endless chain extending about the first and second sprockets;

a clutch permitting the gear linkage to be manually temporarily disengaged from the motor drive shaft; and means for automatically locking the sectional door when fully closed, wherein the locking means automatically disengages when the automatic opener is actuated to open the sectional door;

wherein the gear linkage includes a drive unit drive shaft extending generally perpendicularly relative to the motor drive shaft, and a gear mounted to the drive unit drive shaft and slidable therealong between a first position wherein the gear is driven by a worm fixed to the motor drive shaft, and a second position wherein the gear is disengaged from the worm, wherein the clutch includes means for biasing the gear into its first position, and manually actuable means for moving the gear against the biasing means into its second position.

28. The automatic opener of claim 27, wherein the biasing means comprises a compression spring, and wherein the means for moving the gear to its second position includes a gear abutment having a peripheral groove and which is fixed to a face of the gear and slidable therewith along the drive unit drive shaft, and a pivot lever pivotally connected adjacent to the rotating means, the pivot lever having a first arm that supports a groove follower disposed within the groove, and a second arm that may be pulled to pivot the pivot lever about its pivotal connection to cause movement of the groove follower away from the worm and thus move the gear abutment and the attached gear out of the first position toward the second position.

29. The automatic opener of claim 28, including means for manually unlocking the automatic locking means from a remote location, wherein the unlocking means includes a lock mechanism fixed relative to a selected structure, the lock mechanism including a housing that may be rotated by means of a key, wherein the lock housing has attached thereto a rope which extends to the second arm of the clutch pivot lever, whereby spooling of the rope onto the lock mechanism causes the clutch to disengage the gear from the worm, thus disengaging the automatic locking means.

30. The automatic opener of claim 27, including means for rotationally coupling the gear to the drive unit drive shaft when the gear is in its first position.

* * * * *